US010543390B2

(12) United States Patent
Hugou et al.

(10) Patent No.: US 10,543,390 B2
(45) Date of Patent: Jan. 28, 2020

(54) METHOD TO ASSIST WITH USING A SEATING DEVICE, AND ELECTRONIC OBJECT CARRYING OUT SAID ASSOCIATED METHOD AND SYSTEM

(71) Applicant: ACTIVE BASE, Luxembourg (LU)

(72) Inventors: Olivier Hugou, Juan-les-pins (FR); Guilbaut Colas, La Tronche (FR)

(73) Assignee: ACTIVE BASE, Luxembourg (LU)

( * ) Notice: Subject to any disclaimer, the term of this patent is extended or adjusted under 35 U.S.C. 154(b) by 0 days.

(21) Appl. No.: 15/771,306

(22) PCT Filed: Oct. 26, 2016

(86) PCT No.: PCT/EP2016/075867
§ 371 (c)(1),
(2) Date: Apr. 26, 2018

(87) PCT Pub. No.: WO2017/072199
PCT Pub. Date: May 4, 2017

(65) Prior Publication Data
US 2018/0353791 A1 Dec. 13, 2018

(51) Int. Cl.
*A63B 21/002* (2006.01)
*A63B 21/00* (2006.01)
(Continued)

(52) U.S. Cl.
CPC ..... *A63B 21/0023* (2013.01); *A47C 9/002* (2013.01); *A63B 21/4029* (2015.10);
(Continued)

(58) Field of Classification Search
CPC .. A47C 3/029; A47C 3/28; A47C 3/40; A47C 7/004; A47C 9/002; A47C 9/025;
(Continued)

(56) References Cited

U.S. PATENT DOCUMENTS 4,130,263 A * 12/1978 Roericht ..... A47C 9/025 248/371
5,590,930 A * 1/1997 Glockl ..... A47C 3/0257 297/258.1
(Continued)

FOREIGN PATENT DOCUMENTS

DE 2314717 A1 10/1974
DE 19533558 C1 11/1996
WO WO 2014/174227 A1 10/2014

OTHER PUBLICATIONS

International Search Report (PCT/ISA/210) dated Jan. 4, 2017, by the European Patent Office as the International Searching Authority for International Application No. PCT/EP2016/075867.
(Continued)

*Primary Examiner* — Andrew S Lo
(74) *Attorney, Agent, or Firm* — Buchanan Ingersoll & Rooney PC

(57) ABSTRACT

The invention relates to a method to assist with using a pendula seating device, said device comprising a spherical foot, a seating portion, a body being secured at a first end to said foot and at a second end to the seating portion and a position-measurement sensor being secured to said device. The invention also relates to a remote electronic object carrying out said method by the processing unit thereof, the remote electronic object also comprising output means and means ensuring communication with said seating device. Said electrical object also comprises a memory of programs comprising instructions of a computer program product the execution or interpretation of which by the processing unit causes the implementation of the assistance method.

16 Claims, 3 Drawing Sheets

(51) Int. Cl.
*A63B 23/04* (2006.01)
*A63B 23/02* (2006.01)
*A47C 9/00* (2006.01)

(52) U.S. Cl.
CPC ..... *A63B 23/0205* (2013.01); *A63B 23/04* (2013.01); *A63B 2208/0233* (2013.01); *A63B 2220/16* (2013.01); *A63B 2225/50* (2013.01)

(58) Field of Classification Search
CPC . A47C 31/008; A63B 21/002; A63B 21/0023; A63B 21/4029; A63B 2208/0233; A63B 2220/16; A63B 23/00; A63B 23/0205; A63B 23/04; A63B 2225/50
USPC ..... 482/8
See application file for complete search history.

(56) References Cited

U.S. PATENT DOCUMENTS 5,673,966 A * 10/1997 Morton, Jr. ..... A47C 9/10 297/195.11
5,921,628 A * 7/1999 Glockl ..... A47C 9/025 297/338
6,666,802 B1 * 12/2003 Rasmussen ..... A63B 21/0608 482/140
6,997,511 B2 * 2/2006 Marchand ..... A47C 9/025 297/313
7,156,790 B2 * 1/2007 Johnsen ..... A63B 21/0004 482/146
8,136,876 B2 * 3/2012 Bellvis Castillo ..... A47C 9/002 297/195.11
8,403,408 B2 * 3/2013 Hosler ..... A47C 9/025 297/4
8,998,319 B2 * 4/2015 Bahneman ..... A47C 9/00 297/195.11
9,010,867 B2 * 4/2015 Martin ..... A47C 3/029 297/271.5
9,474,377 B2 * 10/2016 Keen ..... A47C 7/506
2003/0164633 A1 * 9/2003 Jakus ..... A47C 9/002 297/271.5
2004/0130452 A1 * 7/2004 Cherubini ..... G08B 21/22 340/573.7
2007/0138850 A1 * 6/2007 Oettinger ..... A47C 3/029 297/271.5
2008/0097256 A1 * 4/2008 Torres ..... A61G 5/045 601/24
2008/0242521 A1 * 10/2008 Einav ..... A61B 5/1116 482/110
2009/0001788 A1 * 1/2009 Lenz ..... A47C 9/002 297/217.4
2013/0267391 A1 * 10/2013 Todd ..... A63B 21/4047 482/97
2015/0038301 A1 * 2/2015 Todd ..... A63B 23/0216 482/97
2016/0038780 A1 2/2016 Hugou et al.

OTHER PUBLICATIONS

Written Opinion (PCT/ISA/237) dated Jan. 4, 2017, by the European Patent Office as the International Searching Authority for International Application No. PCT/EP2016/075867.

* cited by examiner

METHOD TO ASSIST WITH USING A SEATING DEVICE, AND ELECTRONIC OBJECT CARRYING OUT SAID ASSOCIATED METHOD AND SYSTEM

The invention concerns a method to assist with using a seating device, said method being carried out by a remote electronic object advantageously communicating with said seating device. Said method can be used for all types of use and preferably, but without limitation, within the scope of implementing muscle re-education and/or strengthening protocols.

As an example of a preferred but non-limiting application, the invention will be described through an application connected with a dynamic pendula stool enabling an isometric contraction of the muscle groups of the lower limbs and abdomen in a sitting position.

Throughout the world, tens, or even hundreds, of millions of people work and spend their days sitting in a chair at a desk. In the field of chairs or suchlike, such as stools or more generally seating devices, office chairs are very often designed so that the body of the person sitting at the desk is accommodated in an ideal sitting position in which anatomical constraints are avoided in order to guarantee user comfort. These seats generally consist of a base bearing a seating portion and a back, the back being capable of being articulated in relation to the base with a return means to improve chair comfort. However, such office chairs have the drawback of not stressing the leg and back muscles so that the users of these chairs risk a degeneration of the spinal muscles and vertebral damages such as, for example, disk wear due to poor posture. To overcome these drawbacks, in order to have a good posture, some sedentary workers have decided to use a "Pezzi®" ball, for example. These Pezzi® balls enable a user to sit on them and work the leg and back muscles. However, these "Pezzi®" balls turn out to be particularly bulky and so are particularly unsuitable for use in an office.

Numerous gymnastic devices have also been developed such as, for example, the bicycle, the press or even the rowing machine, allowing the leg muscles and abdominal muscles to be worked. However, these devices have the drawback, apart from the fact that they cannot be used in an office, of requiring movements limiting the use of said devices, either by a lack of mobility of the user or by a lack of space. Alternatively, to overcome in particular the lack of space, electro-stimulation type devices, enabling an isometric contraction of the leg muscles and abdominal muscles, can be used. However, they are difficult to implement particularly in an office, the placing of electrodes requiring clothes to be removed.

In order to overcome all or some of the above-mentioned drawbacks, numerous so-called dynamic chairs or stools have already been devised such as, for example, those described in connection specifically with German patent documents DE 2314717 and DE 19533558. German patent application DE 2314717 describes a chair comprising two ball joints provided with springs wherein the user is in a state of unstable equilibrium so that he can return to a normal position by means of a lateral deviation by active footwork. By contrast, German patent application DE 19533558 describes a dynamic active chair comprising a foot that has a curved base surface, with the concavity facing upwards, to enable a tilting movement, a column connected to the foot and a seating portion mounted at a supporting point at the upper end of said column. The curved base surface of the foot rests directly on the ground and has a spherical curvature in at least one partial zone. The seating portion is mounted at its point of support so as to be able to incline in every direction. Said point of support is located either below the center of curvature of the base surface, or is adjustable within a height range the lower limit of which is located below the center of curvature and the upper limit of which is located above the center of curvature. The seating portion is mounted on a connecting element formed by a resilient element, forming a spring and bearing on a support secured to the upper end of the column. Such devices, described for example in connection with German patents DE 2314717 and DE 19533558, have the drawback of being cumbersome and not enabling an isometric contraction of the muscle groups of the lower limbs in particular.

In proposing a dynamic pendula stool, of simple and inexpensive design, as disclosed in document WO2014/174227, also enabling an isometric contraction of the muscle groups of the lower limbs and abdomen in a sitting position, a large number of the previously-described drawbacks have been eliminated. In fact, unlike previous devices, such a device occupies very little space enabling a one-off use, replacing a conventional office chair, or a continuous use.

Such a dynamic pendula stool, according to a non-limiting embodiment, and its operation are described specifically in connection with FIGS. 1 and 2. Said stool T comprises a foot 1, a column 2 secured to said foot 1 and a seating portion 3 secured to the upper end of said column 2. Said column 2 can advantageously consist in a telescopic column comprising a lower part 2*a* secured to a spherical foot 1, possibly having a diameter less than or equal to twenty centimeters, and an upper part 2*b*, the free end of which is provided with an articulation 9 comprising three degrees of freedom and secured to the lower face of the seating portion 3. By way of example, according to FIGS. 1 and 2, the column can consist of two circular-section tubes, a first tube forming the lower part 2*a* provided at its lower end with a threaded rod 4 extending coaxially to said tube, and a second tube forming the upper part 2*b*, said second tube having an outer diameter just smaller than the inner diameter of the tube of the lower part, so that the upper part 2*b* can slide within the lower part 2*a*. Such sliding specifically allows the length of the column to be adjusted according to the morphology of the user and/or the desired difficulty of the work on the muscles of the lower limbs.

The spherical foot 1 can advantageously be obtained from a non-slip material and, preferably, from an elastomer, in order to prevent the stool T from slipping on smooth floors, such as on tiles for example. Moreover, the spherical foot 1 can comprise a socket 6 extending radially and provided with an internal thread 7 cooperating with a threaded rod 4 secured to the lower end of the lower part of the column. Moreover, the seating portion 3 has a substantially parallelepiped shape the width of which is substantially equal to the width of the pelvis of a person of average weight. The upper part of said seating portion 3 can comprise a resilient layer 8 to improve user comfort. Said seating portion is articulated at the upper end of the upper part 2*b* of the column 2 by the articulation 9. In this embodiment, said articulation 9 consists in a ball joint comprising a seat 10 secured to the lower face of the seat 3, in its central part, and receiving a ball joint 11 secured to the upper free end of the upper part 2*b* of the column 2. Advantageously, the seat 10 of the articulation 9 can be connected to the seating portion 3 by a threaded rod 12 secured to said seat 10 and cooperating with a thread 13 made in said seating portion 3. Thus, the seating portion 3 can be rapidly changed, depending specifically on the user's preferences.

As mentioned above, the operation of the stool T is described with reference to FIG. 2. The user adjusts beforehand the length of the column 2, according specifically to his morphology, then he places the seating portion 3 beneath his bottom, the foot 1 bearing on the ground. In this way, the column 2 can form an angle of between 30 and 90° to a horizontal plane formed by the ground, said angle depending on the size of the user and the chosen length of said column 2. Thus, when the user is seated on the stool T, the smaller the angle of the column to the horizontal plane, the greater the work of the muscle groups of the lower limbs. In this position of use, the stool then causes an isometric muscular contraction of the gastrocnemius, hamstring, quadriceps, gluteal, lumbar dorsal and apsidal muscles. Isometric muscular contraction is achieved by proprioception and equilibration work by the user who compensates for the instability of the stool. In fact, the articulation of the seating portion 3 on the column 2 and the single point of support of the spherical foot 1 cause a lateral, forward and backward inclination forcing the user to adopt a stable position in which the line of the shoulders is parallel to that of the pelvis, a push on the feet causing the isometric contraction of the muscles of the lower limbs and an unstable gluteal push compensated for by the proprioception and contraction of the lumbar and abdominal muscles.

Secondarily, it is envisaged that the column 2 and/or the seating portion of said stool T can comprise a position sensor (not shown in FIG. 1 or 2), such as an accelerometer for example, connected to a wireless communication means, such as a Bluetooth, WiFi or similar transmitter. In this way, the position of the column 2 and/or of the seating portion 3 can be transmitted to a remote electronic object, such as, for example, a Smartphone, a digital tablet and/or a personal computer. The electronic object can advantageously comprise a computer program enabling the current position of the column 2 and/or of the seating portion 3 in relation to a predetermined ideal position to be displayed.

As stated above, the stool T can advantageously be arranged to enable the isometric contraction of the muscle groups of the lower limbs and the abdomen in the sitting position. Thus, the stool is particularly useful and usable in offices, but can also be used in programs of physical reeducation and/or muscle reinforcement. However, although offering a tool, in the form of a special seating device, suitable for implementing reeducation or reinforcement protocols, the pendula stool, like all the seating devices previously mentioned, has a certain number of drawbacks. In fact, there are many users of a seating device who, after becoming seated on said seating device, do not know the exercises and/or movements, of which the range, speed and repeatability are predetermined in order to meet particular constraints and have the aim of muscular development and/or functional reeducation. It is thus necessary, indeed in some cases compulsory, to resort to a supervisor, a therapist such as a physiotherapist for example, or even a coach or sports trainer to learn, or indeed intensify if necessary, the appropriate workouts. Moreover, it may be disagreeable to sit for long periods on a stool, or more generally any seating device envisaged for reeducation and/or reinforcement protocols that are sometimes repetitive and tiresome. When exercising alone, in other words completely independently without the aid of a coach, users often find it difficult to commit themselves and initially draw the stimulation and energy needed to train, but also to adhere to a full training protocol and repeat it regularly. Lastly, if users use the seating device incorrectly, they may not achieve their objective and ultimately tire of the tool due to lack of perceived progress in their practice and end up being discouraged.

This invention resolves all or some of the drawbacks raised by known solutions.

Some of the numerous advantages of a method to assist with using a seating device according to the invention allow:

- a method to be proposed enabling an appropriate use of a seating device, more particularly a dynamic pendula stool, by optimizing all of the possibilities offered by said seating device;
- an effective solution to be adopted so as to create regular and beneficial commitment to using a seating device, improving the benefit by stimulating the patient and/or user, without the need to resort to a therapist or sports coach, offering assistance with using this fun and recreational device;
- the maximum possible benefit to be derived from the seating devices already used today, by encouraging the independence of the user thereof.

To this end, a method to assist with using a seating device is specifically envisaged, said device comprising a spherical foot, a seating portion, a body being secured at a first end to said foot and at a second end to the seating portion, a position-measurement sensor being secured to said device, said method being carried out by a processing unit of a remote electronic object, the remote electronic object also comprising output means and means providing communication with said seating device. Said method comprises:

- a step for decoding a position message of the pendula seating device, said message being received by the communication means of the remote electronic object and conveying the position data, and for extracting therefrom the content of said position data,
- a step for triggering the display, by the output means, of a first indicator expressing said extracted position data.

In order to ensure an appropriate use of the seating device by the user by setting him some target objectives, a method to assist with using a seating device according to the invention also comprises a step for generating determined reference position data expressing a target to be reached and a subsequent step for triggering the display, by the output means, of a second indicator expressing said reference position data.

In order to encourage the user to adhere to a protocol of therapeutic re-education and/or muscle reinforcement, the first and/or second indicators, displayed by the output means according to a method to assist with using a seating device according to the invention, can consist in first and/or second avatars.

In order to enable a user to reproduce exercises and/or movements, the range, speed and repeatability of which are predetermined in order to respond to particular constraints and have an objective of muscular development and/or functional re-education, a method to assist with using a seating device can be carried out iteratively.

Furthermore, the step for generating the reference position data of such a method can generate values of position data different to those generated during the previous iteration.

Advantageously but without limitation, the values of the reference position data of a method according to the invention can be determined according to a function or a scenario taking into account values of previous reference position data.

Alternatively, or in addition, the values of reference position data of a method according to the invention can be determined on the basis of an ordered and predetermined list of reference position values.

In order to enable the user of a seating device to observe his progress in using such a device, a method to assist with using the latter according to the invention can also comprise a step to count occurrences, during which the values of the extracted position data of the device and the reference position data are substantially identical.

Preferably but without limitation, a method to assist with using a seating device according to the invention can also comprise a step for triggering the display, by the output means of the electronic object, of the current value of the occurrence counter.

In order to enable personalization of the method to assist with using a seating device according to the invention and improve the commitment of a user to said method, the latter can also comprise a step, prior to the display of the first or second indicator, in order to select, among a plurality of determined graphic representations, a first graphic representation, as soon as there is a mismatch of the respective values between the extracted position data and the reference position data, and/or a second graphic representation, as soon as there is a match of the respective values between the extracted position data and the reference position data.

Alternatively, or in addition, in order to increase the possibilities of use of said seating device, the latter can also comprise a sensor for measuring the pressure exerted along an axis passing through the body from the seating portion to the spherical foot. According to this particular arrangement, a method to assist with using a seating device can also comprise:

- a step to decode a pressure message relating to said pendula seating device, said message being received by the communication means of the remote electronic object and conveying pressure data, and to extract therefrom the content of said pressure data,
- a step to carry out a determined processing in response to a pressure datum higher than a determined threshold.

As a preferred but non-limiting example, the determined processing of a method according to the invention may consist in a step to generate a validation command of a graphic menu outputted by the output means of the electronic object.

Alternatively, or in addition, in order to facilitate the use of said seating device, the latter can comprise or cooperate with a support accessory in the form of a stick, said accessory comprising a position-measurement sensor delivering accessory position data transmitted in the position message together with the position data of the body of device. According to this specific arrangement, the step for decoding a position message of a method according to the invention can also consist in extracting from said message the values of the accessory position data. Moreover, said method can comprise a step to trigger the display, by the output means, of a third indicator expressing said accessory position data.

According to a second subject-matter, whatever the variation of a method to assist according to the invention, and in order to adapt a communicating electronic object so that it can carry out such a method, the invention concerns a computer program product comprising a plurality of program instructions which, when they are:

- previously recorded in a memory of programs of an electronic object, also comprising a processing unit, communication means ensuring a communication with a remote seating device and output means, said memory of programs, communication means and output means cooperating with said processing unit;
- executed or interpreted by said processing unit, cause the implementation of a method to assist with using said seating device according to a first subject-matter of the invention.

According to a third subject-matter, the invention also concerns an electronic object comprising a processing unit, a memory of programs, communication means ensuring a proximity communication with a remote seating device and output means, said memory of programs, said communication means and said output means cooperating with said processing unit. So that an electronic object can guarantee to assist with using a seating device, the memory of programs of such an electronic object comprises the instructions of a computer program product according to the second subject-matter of the invention.

Lastly, according to a fourth subject-matter, the invention concerns a system to assist with using a seating device comprising the said seating device, a remote electronic object in communication with said seating device, said electronic object being according to the third subject-matter of the invention, namely carrying out a method to assist with using the seating device according to the said invention.

Alternatively, or in addition, a system according to the invention can also comprise a support accessory in the form of a stick cooperating with said seating device. According to this particular arrangement, the electronic object according to the invention can also comprise, in its memory of programs, the instructions of a computer program product according to the invention, enabling said object to use the data transmitted by said accessory via said seating device.

Further features and advantages will emerge more clearly from the following description and accompanying Figures, in which:

FIG. 1, previously described, is a longitudinal cross-sectional view of a preferred but non-limiting embodiment of a known seating device, in the form of a dynamic pendula stool;

FIG. 2, previously described, is a schematic perspective view of a user seated on a known seating device, in the form of a dynamic pendula stool;

FIGS. 3 and 6 represent graphic descriptions of first and second embodiments of a system to assist with using a seating device according to the invention, specifically comprising a seating device and a remote electronic object cooperating with said seating device.

Figure 1:
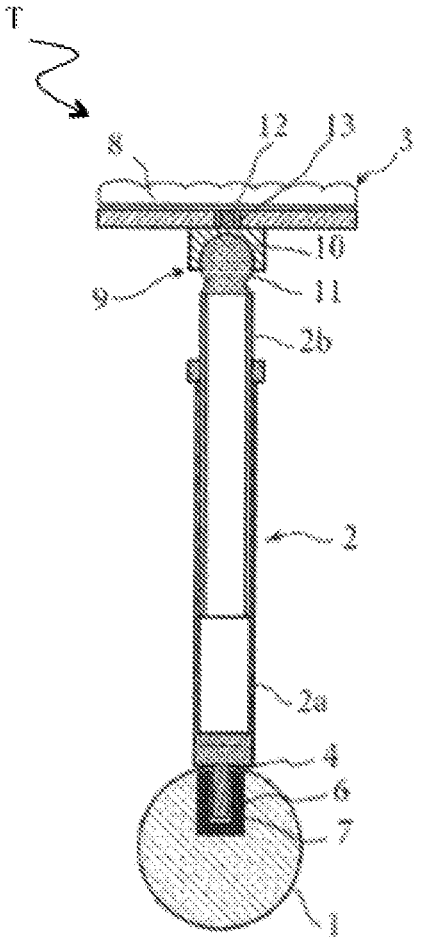
Figure 2:
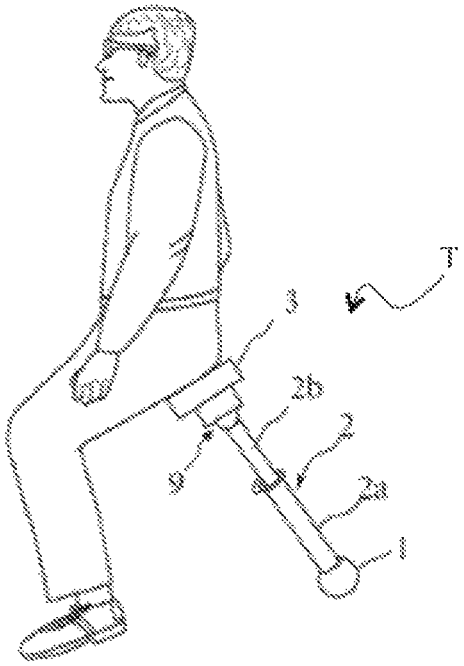

A pendula seating device according to the invention is akin to a known seating device. Thus, such a seating device comprises a foot 1, advantageously spherical. As mentioned above, the presence of such a foot 1 allows the seating device to create an instability, forcing the user of such a seating device to perform a proprioception and equilibration work, ultimately allowing exercises to be carried out relating to isometric muscle contraction, that may be the subject of a physical reeducation and/or muscle reinforcement protocol. In addition, said seating device comprises a seating portion 3, on which a user of said device can sit. Moreover, the seating device also comprises a body being secured at a first end to said foot 1 and at a second end to the seating portion 3. By way of a preferred but non-limiting example of application, such a pendula seating device can consist in a pendula dynamic stool such as, for example, that described in connection with FIGS. 1 and 2 or that present in the system described in connection with FIGS. 3 and 6. According to this preferred example, according to FIGS. 1, 2, 3 and 6, the body of said seating device can consist in a column 2, advantageously telescopic, said column 2 comprising a lower part 2*a* secured to the spherical foot 1 and an upper part 2*b* the free end of which is provided with a articulation 9 comprising three degrees of freedom and secured to the lower face of the seating portion 3. The invention shall not, however, be limited to this single example of application: it can be used in connection with all seating devices, such as those previously mentioned according to the state of the art, comprising a spherical foot, a seating portion and a body, cooperating at each of its ends with said foot and the seating portion, thus allowing an instability to be created for the user seated on said device.

Figure 3:
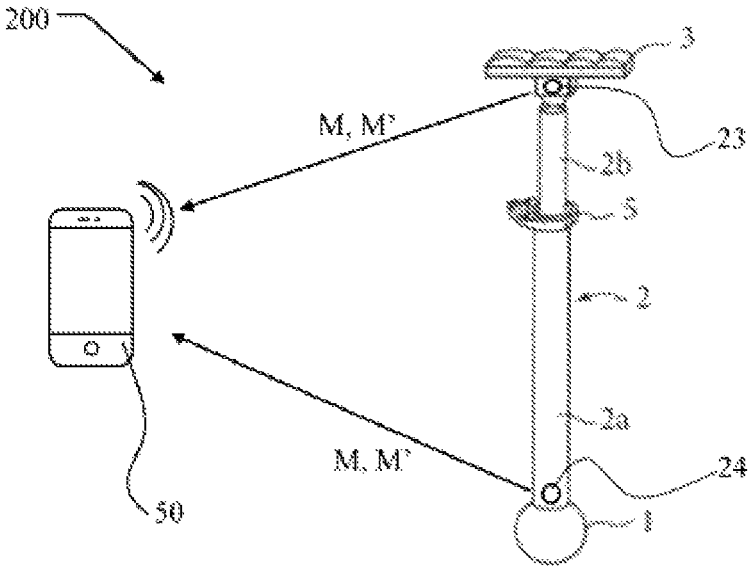
FIG. 3 represents a graphic description of a first embodiment of a system to assist with using a seating device according to the invention.
Figure 6:
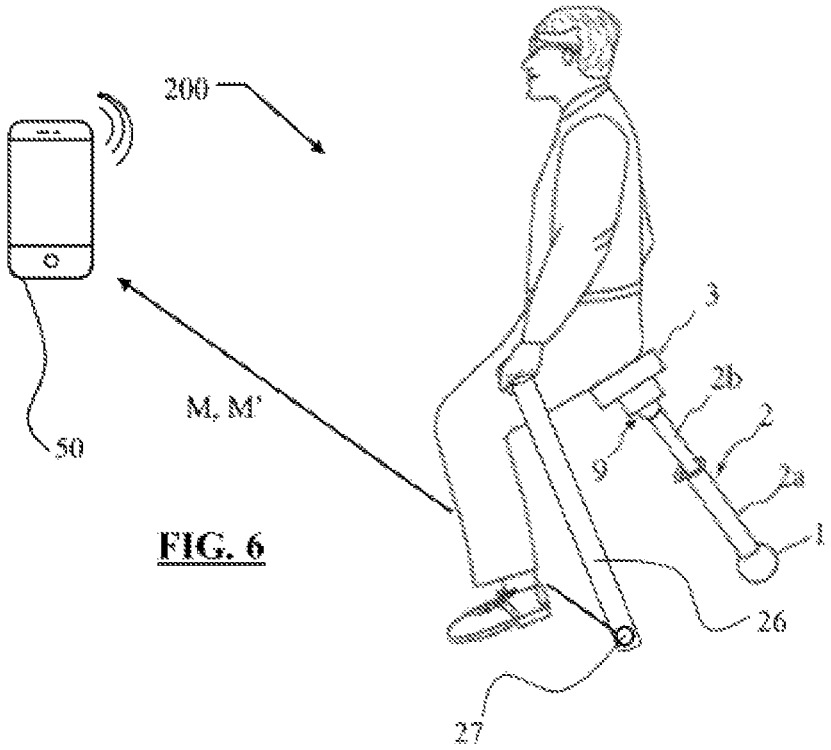
FIG. 6 represents a graphic description of a second embodiment of a system to assist with using a seating device according to the invention.

According to FIGS. 3 and 6, the seating device also comprises a position-measurement sensor 23, 24 being secured to said device. Preferably but without limitation, such a position-measurement sensor can comprise an accelerometer or even a gyrometer. According to the invention and throughout this document, the position of the seating device is defined as the position of said device in relation to a predefined horizontal surface, such as the ground for example, in a two- or three-dimensional terrestrial or inertial frame of reference. Similarly, throughout this document, the word "position" may be replaced with inclination or acceleration. Also, such a position-measurement sensor can advantageously cooperate or communicate with a processing unit of a remote electronic object 50 and deliver or transmit thereto a position message or signal. Such a position message or signal can advantageously comprise two types of information, namely a continuous position measurement or a detection of position. According to a first embodiment, the position-measurement sensor can thus cooperate by means of a mechanical connection that is embedded in, i.e. advantageously fixed to, said device, more particularly on the body of said device. According to the preferred example of application, described in connection with FIG. 4, such a position-measurement sensor 23, 24 can advantageously be placed on and/or in the telescopic column 2. According to a first example, said position-measurement sensor 23 can be fixed or in the articulation 9, ensuring cooperation between the seating portion 3 and the telescopic column 2. Alternatively, or in addition, according to a second example, said position-measurement sensor 24 can advantageously be positioned on or in the lower part 2*a* of the telescopic column 2, near the spherical foot 1. The invention shall not be limited, however, only to these variations. Such a position-measurement sensor can advantageously cooperate with and be fixed onto any element of said device, the position of such a sensor depending on the desired function. The invention can also envisage the concomitant use of a plurality of position-measurement sensors.

As already mentioned, the invention concerns, according to a first subject-matter, a method to assist with using a pendula seating device. Such a method specifically allows improvement in the time, technical sophistication, ease and monitoring of use of said seating device with no need to resort to the assistance of a specialized attendant, such as a therapist or a sports coach.

Such a method to assist with using a seating device is advantageously carried out by a remote electronic object 50 of said seating device, said object advantageously being communicating. By way of preferred but non-limiting examples of application, such an electronic object 50 can consist in a smartphone, a digital tablet and/or a personal computer. More precisely, the electronic object 50 comprises a processing unit (not shown in the Figures), consisting in one or more microcontrollers or microprocessors, responsible for carrying out said method to assist with using a seating device or any other processing of the data such as, for example, position data previously transmitted by a seating device. The electronic object 50 also comprises a memory of programs (not shown in the Figures), said memory cooperating advantageously with the processing unit by means of internal communication buses or by coupling, arranged to comprise, in the form of a computer program product previously loaded into said memory, a method to assist with using a seating device according to the invention. Said data can advantageously be, in total or in part, recorded on one or more data memories (not shown in the Figures), usually electrically erasable and writable. The data memory can advantageously cooperate with the processing unit by means of internal communication buses and/or form a single entity with the memory of programs previously mentioned.

Furthermore, the electronic object 50 comprises output means 30 advantageously cooperating with the processing unit through internal communication buses. Such output means 30 ultimately allow a printout or graphic representation specifically of position data to be delivered and/or outputted for a user of the seating device, preferentially but without limitation, two- or three-dimensional. Such a graphic representation can, advantageously and prior to its display, be parameterized, so that, for example, the color, size and/or form of such a representation can be automatically or manually selected. The invention shall not be limited, however, solely to these parameters. Also, by way of non-limiting examples, such output means 30 can advantageously consist in a man/machine interface or graphic interface, a screen, possibly a touch-screen, or any other equivalent means suitable for displaying said graphic representation.

Moreover, in order to receive data from the outside world and more particularly from a seating device, an electronic object 50 comprises means (not shown in the Figures) for communication with the outside, ensuring a communication, possibly proximity communication, with said remote seating device, said communication means also cooperating with the processing unit by means of internal communication buses. Said communication means can thus ensure a communication, possibly wired or wireless, for example when the communication means emit a wireless communication, by implementing WiFi or Bluetooth communication protocols, destined for any remote device such as, for example, the pendula seating device, provided that the latter is within communication range. Through said communication means, the electronic object 50, or more precisely the processing unit thereof, can transmit and/or receive messages or signals, hereinafter called messages by way of simplification, possibly position messages, destined for or originating from a pendula seating device located within communication range.

Furthermore, so that the electronic object 50 can function completely autonomously, the latter can advantageously comprise its own electrical power source (not shown in the Figures), in the form of one or more capacitors previously charged and capable of delivering sufficient electrical power to enable the operation of the electronic object. The capacity of an electronic object to be able to operate is directly linked to the remaining and available energy capacity of said electronic object.

FIG. 6 shows specifically a simplified flow chart of an embodiment of a method 100 to assist with using a seating device.

According to FIG. 6, the method 100 to assist with using such a seating device, advantageously carried out by an electronic object 50, firstly comprises a step to decode 110 a position message M of the pendula seating device, said message M being received by the communication means of the remote electronic object 50. Said position message M can thus comprise several information fields, such as an identifier of the seating device, one or more position data of which the value or values identify the position measurement in real time of the seating device, i.e the position of said device in relation to a predefined horizontal surface on which the device is used, such as for example the ground, in a terrestrial or inertial frame of reference, the accelerations and/or inclinations of said seating device according to the position-measurement sensor or sensors used. Subsequently and by way of simplification, we will call such data "position data". Step 110 ultimately consists in obtaining the value or values of the extracted position data.

Then, the electronic object 50 comprising the output means 30, such as by way of non-limiting example a man/machine interface, such as a screen or any other equivalent means, to a user of said object and/or device, said output means cooperating with the processing unit of said electronic object 50, a method 100 to assist with using a seating device according to the invention comprises a subsequent step 120 to triggered the display, by the output means 30, of a first indicator 31 expressing said extracted position data. The display of such a first indicator can advantageously be two- or three-dimensional and consist chiefly in displaying a virtual object the parameters of which can be defined or predetermined. The graphic representation of such a first indicator depends generally on a large number of factors, specifically and by way of non-limiting examples, on the user of the seating device, on the parameterizable elements on the output means, etc. Thus, prior to step 120 of displaying such a first indicator, a method 100 according to the invention may comprise a step for configuration of the respective parameters of said output means, specifically and possibly of the graphic representation of such a first indicator, specifically but without limiting the form, texture or even the color palette used. A non-limiting example of displaying a first indicator 31 by the output means 30 is described in connection with FIG. 4. According to this example, in which the output means 30 advantageously consist in a screen of a smartphone or a digital tablet, the first indicator 31 representing the position of the device, consists in a white circle, filled with black dots, delimited by a black line in a two-dimensional frame of reference.

In order to ensure correct use of the seating device by the user by imposing upon him the target objectives of position (s) and/or movement(s), according to FIG. 6, a method 100 to assist the user of a seating device also comprises a step to generate 130 determined reference position data expressing a movement objective or a target to be attained. According to a first example, such a step 130 can advantageously consist in the calculation or construction of values of position data, by means of a predefined algorithm, depending on characteristics, that can be defined in advance, possibly inherent to the user such as, for example, without limitation, the user's morphology, physical condition or experience as regards using such a seating device. Alternatively, or in addition, such a step 130 to generate reference position data can involve selecting said values of position data from an ordered and predetermined list of reference position values. Advantageously, such a step 130 to generate reference position data can also be carried out in parallel, prior to or after the step for decoding 110 a position message M and extracting position data, emanating from the seating device.

Subsequently, the electronic object 50 comprising the output means 30, such as, by way of non-limiting example, a man/machine interface, such as a screen or any other equivalent means, to a user of said object and/or device, said output means cooperating with the processing unit of said electronic object 50, a method 100 to assist with using a seating device according to the invention comprises a subsequent step 140 to trigger the display, by the output means 30 of a second indicator 32 expressing said reference position data. Like the first indicator, the display of such a second indicator can advantageously be two- or three-dimensional and consists chiefly in displaying a virtual object the parameters of which can be defined or predetermined. The graphic representation of such a second indicator also depends generally on a large number of factors. Thus, prior to step 140 of displaying such a second indicator, a method 100 according to the invention may comprise a step of configuration of the parameters of the graphic representation of said second indicator, specifically but without limiting the form, texture or even the color palette used. A non-limiting example of the display of a second indicator 32 by the output means 30 is described in connection with FIG. 4. According to this example, in which the output means 30 advantageously consist in a screen of a smartphone or of a digital tablet, the second indicator representing the reference position consists in a white circle, filled with black diagonal lines, delimited by a black line in a two-dimensional frame of reference.

Figure 4:
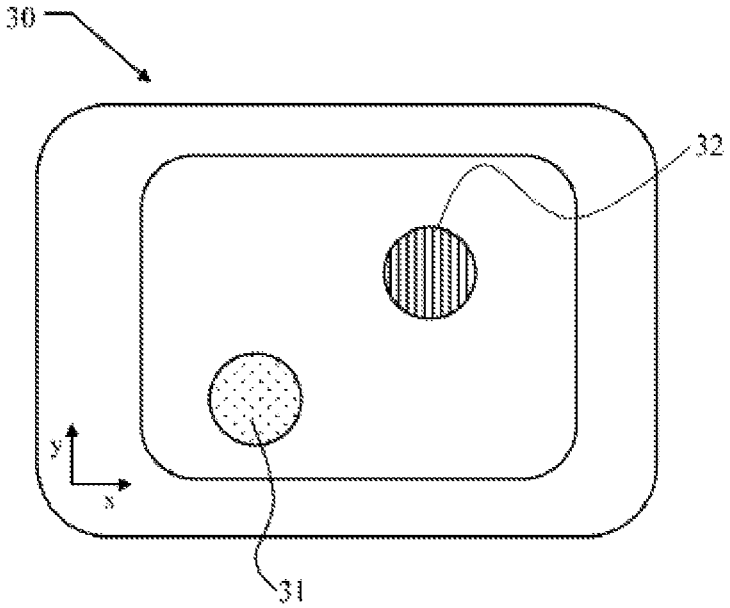
FIG. 4 is a schematic representation of an example of output means, in the form of a graphic interface, of the electronic object of a system to assist with using a seating device according to the invention.
Figure 5:
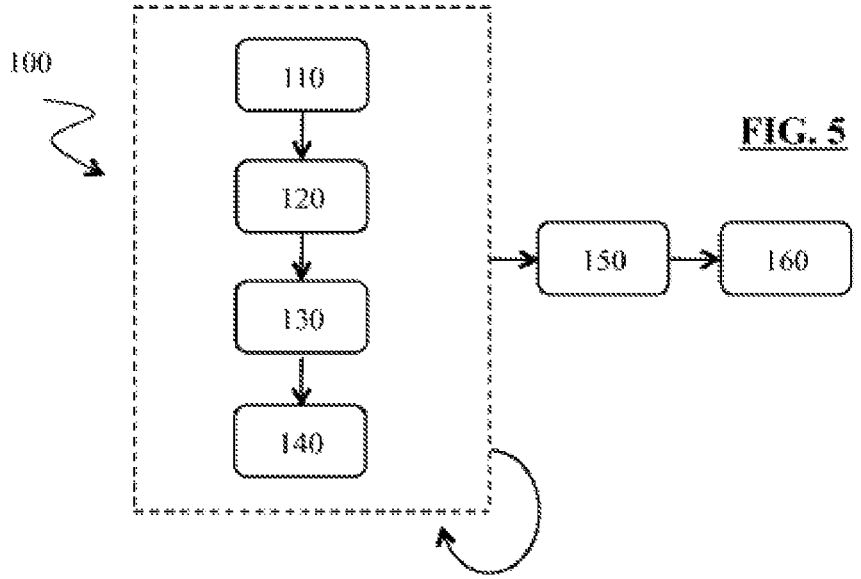
FIG. 5 is a simplified flow chart of a method to assist with using a seating device according to the invention.

Preferably, as described in connection with the example according to FIG. 4, steps 120 and 140 to trigger the respective displays of the first and second indicators are carried out concomitantly, so as to be able to compare the first and second indicators representing the real position data of the seating device and the reference data respectively, in other words the objective, in order specifically to give the user the possibility of evaluating the effort and/or progress margin to be provided in order to achieve his goal. The simultaneous display of the first and second indicators also offers a playful nature to a series of exercises, mitigating the boring and laborious nature of the latter for a user of the seating device.

In order to maximize a user's commitment to a protocol of therapeutic reeducation and/or muscle reinforcement and to enhance the recreational aspect of the reeducation and/or reinforcement sessions that can be, in many cases, off-putting, it may be necessary to introduce fun elements into the display of the respectively extracted or reference first and/or second position indicators. In addition to their recreational side, such elements or indicators have an immediate effect on the attitude of the user and cause him to make optimum use of his device, which he could only expect if requiring follow-up from a professional. To achieve this, the first and/or second indicators displayed by a method to assist with using a device according to the invention might consist in first and/or second avatars. Throughout this document and in the context of the invention, the notion of an "avatar" is defined as the appearance assumed by an individual in a computer graphic environment, or more generally the two- or three-dimensional graphic representation of a predefined virtual individual or object. Alternatively, according to this particular embodiment, the invention thus envisages that a method 100 to assist with using a device according to the invention can comprise a step, prior to the first use of said device, to automatically configure the first and/or second position indicators, by choosing one or more specific aspects of the avatar such as, for example, if the avatar is a human being, the gender of the avatar, the color of the hair or skin thereof, the clothes worn by the avatar, etc.

As previously mentioned, the protocols of physical reeducation and/or muscle reinforcement usually consist in one or more workouts, specifically comprising exercises and/or movements, of which the range, speed and repeatability are predetermined to respond to particular constraints and aim at an objective of muscle development or functional reeducation. In order comply with these protocols, a method 100 is envisaged to assist with using a seating device according to the invention that can be carried out iteratively. It is possible for a user of a seating device to perform one or more series of exercises, with or without the presence of a specialized attendant, with the certainty, or at least a degree of confidence, that the different workouts are being performed correctly. When using such an iterative processing, step 130 for generating the reference position data can generate position data values different to those generated during the previous iteration. Like the examples of generating previously described, the step for generating 130 the values of position data different to those generated during the previous iteration can be carried out by several processings.

According to a first variation, said values of reference position data can be determined on the basis of a function or a scenario taking into account the values of the previous position data. The use of such a function or of such a scenario with regard to other possible ones can advantageously depend on the characteristics inherent to the user such as, for example, his morphology, his physical condition, his experience as regards using such a seating device or even and finally the desired difficulty of the work. By way of a non-limiting example, in the context of a session of physical reeducation, depending on the muscles to be reeducated or reinforced, a scenario based on a series of exercises of "S"- or "8"-shaped movements can be envisaged. Thus, in order to perform said movements, a method 100 to assist according to the invention can comprise a prior step to configure a function or a scenario, said step consisting in interpreting an instruction of the user or supervisor, entered or recorded via an input interface cooperating with the processing unit of the electronic object such as, for example, a keyboard or a mouse. Such an instruction consists in manually selecting, i.e. possibly by the user or a supervisor, or even automatically, from a plurality of scenarios or functions in a database possibly entered in the data memory of the electronic object carrying out said method, a scenario or envisaged function.

Alternatively, or in addition, the values of reference position data can be determined on the basis of an ordered and predetermined list of reference position values. Thus, step 130 to generate the reference position data involves choosing or selecting, in a database possibly entered in a data memory of the electronic object carrying out said method, possibly in the form of existing reference position values, reference position data. The choice of such reference position data can be made by using the characteristics inherent to the user such as, for example, his morphology, his physical condition, his experience as regards using such a seating device or even finally the desired difficulty of the work.

In addition, the invention envisages the possibility of increasing the motivation of a user of a seating device or the supervisor of such a user and thus sustain the commitment of said user to his device and help him to improve his performance.

Also, a method 100 to assist with using a seating device according to the invention, when said method is carried out iteratively, can advantageously and also comprise a step 150 to count the occurrences, during which the values of the extracted position data of a position message issued by the device and the values of the reference position data are substantially identical. To do this, step 150 to count the occurrences can advantageously comprise a prior step to compare the values of the position data emanating from the device and the values of the reference position data. Possibly, step 150 to count the occurrences can advantageously comprise a prior step to set the value of the occurrence counter to zero. When said values are substantially identical, step 150 for counting the occurrences can advantageously comprise a subsequent step to increase by one unit the current value of the occurrence counter and then store said current value of the occurrence counter in the data memory of the electronic object carrying out said method 100. The invention shall not be limited, however, to this single embodiment: it could possibly be envisaged that, before using the seating device, the current value of the occurrence counter could be configured to a target value, by storing said value in the data memory. According to this embodiment, if said compared data values are substantially identical, step 150 to count the occurrence could then comprise a subsequent step to decrease by one unit the current value of the occurrence counter and then store said current value of the occurrence counter in the data memory of the electronic object carrying out said method 100. The reeducation or reinforcement session, or more particularly the series of exercises, could be regarded as closed when the current value of occurrences is equal to zero.

In addition, in order to reinforce the performance or progress of a user of a seating device and increase his motivation, after the previously described step 150 to count the occurrences, a method 100 to assist with using a seating device according to the invention can comprise a subsequent step 160 to trigger the display, by the output means 30 of the electronic object 50, of the current value of the occurrence counter. Such a step of displaying the current value of the occurrence counter can be implemented on demand by the user or his supervisor, or each time that the occurrence counter is moved. Furthermore, the display of the current value of such an occurrence counter can advantageously be configured or parameterized manually or automatically, like the first and second indicators previously described.

Alternatively or in addition, in order to increase the recreational and fun aspects of a method to assist with using a seating device according to the invention and thus improve the benefit of such use, said method 100 can also comprise a step, prior to the display of the first or second indicator 31, 32, to select, from a plurality of determined graphic representations, a first graphic representation, as soon as there is a mismatch of the respective values between the extracted position data and the reference position data, and/or a second graphic representation, as soon as there is a match of said values. The graphic representation can advantageously be previously selected manually, i.e. possibly by the user or a supervisor, or even automatically, in a database that may be contained in the data memory of the electronic object carrying out said method. Such graphic representations can be parameterized and/or be parameterable, for example as regards the color, size or form of such a representation. Prior to this step, as previously mentioned, said method 100 can also comprise prior steps to automatically configure the respective representations of the first and/or second position indicators.

In order to increase the possibilities offered by a seating device, the latter can also comprise a sensor 24 to measure the pressure exerted along an axis passing through the body from the seating portion to the spherical foot, said measurement sensor being secured to said device. Also, such a pressure-measurement sensor can advantageously cooperate or communicate with a processing unit of a remote electronic object 50 and deliver or transmit thereto a message or signal relating, for example, to a threshold of pressure exerted on the ground by a seating device when a user is seated on said device. Such a message or signal relating to the pressure can advantageously comprise two types of information, namely a continuous pressure measurement or a detection of a pressure threshold reached. If the sensor delivers information relating to a continuous measurement, such information can thus allow the active use time of said seating device to be determined. Preferably but without limitation, such a position-measurement sensor can comprise a piezometer. According to a first embodiment, the position-measurement sensor can thus cooperate according to a mechanical connection that is embedded in, i.e. advantageously fixed to, said device. According to the preferred example of application, described in connection with FIG. 3, such a measurement sensor adapted to detect a pressure and/or a sudden pressure differential can advantageously be placed on and/or in the spherical foot 1.

When such a pressure-measurement sensor is present, a method 100 to assist with using such a seating device, advantageously carried out by an electronic object 50, can also comprise a step for decoding a pressure message M' relating to said pendula seating device, said message being received by the communication means of the remote electronic object 50. Said pressure message M' relating to said device can thus comprise several fields of information, including one or more pressure data of which the value or values identify the current pressure exerted along an axis passing through the body from the seating portion to the spherical foot in real time of the seating device, possibly on the ground, and/or a sudden pressure differential. This step ultimately consists in obtaining the value of said extracted sudden pressure differential or more generally the values of the extracted pressure data.

Once the pressure data have been extracted, the method 100 according to the invention can also comprise a step for carrying out a determined processing in response to one or more pressure data delivering a pressure greater than a determined threshold. Such a threshold can be selected beforehand from a plurality of predetermined thresholds in a list stored in the data memory of an electronic object 50. To ensure the implementation of a specific processing, the method can also comprise a prior step to compare the value of the extracted data resulting from pressure to that of the predetermined threshold and check whether said measured pressure is greater than or equal to the predetermined threshold. The invention also envisages that the processing can be selected on the basis of the values of the pressure data and of said threshold reached by comparison. By way of a preferred but non-limiting example, the determined processing can consist in a step to generate a validation command of a graphic menu outputted by the output means 30 of the electronic object 50. The invention shall not, however, be limited to this type of processing only.

Alternatively, or in addition, once the position data have been extracted, the invention envisages that the method 100 according to the invention can also comprise a step for carrying out a second processing determined in response to a position data value greater than that of a second determined threshold. By way of a preferred but non-limiting example, when the measured position relates to an inclination value, the second determined processing can consist in a step to generate a command to pull down a graphic menu outputted by the output means 30 of the electronic object 50. The invention shall not, however, be limited to this type of second processing only.

As presented by the second embodiment of a system to assist with using a seating device according to the invention described in connection with FIG. 6, the latter can advantageously comprise or cooperate with one or more support accessories in the form, for example, of a stick 26. The presence of one or more sticks 26 occurs in certain useful cases, since they help to achieve lateral equilibration, improve the range of movement and increase the number of exercises that can be performed by the user and finally extend a user's muscle reinforcement by exercise workouts that also stress the upper body. The stick(s) 26 can advantageously consist of a material making them more or less flexible, thus guaranteeing the creation of push reactions and an improved flexibility of use. Preferably, said stick(s) 26 can advantageously comprise a body in the form of a tube, a gripping means, in the form of a handle, cooperating with a first end of said body and a foot or supporting ball cooperating with the other end of said body.

Like said seating device, in order to be able to ensure a better use of said support accessory, the latter can comprise a position-measurement sensor 27 delivering accessory position data transmitted in the position message M together with the position data of the body of the device or more generally of the device per se. Also, such a position-measurement sensor can advantageously cooperate or communicate with the processing unit of a seating device. The accessory position thus measured and translated into accessory position data can consist in two types of information, namely a continuous position measurement of the accessory or an accessory position detection. Preferably but without limitation, such an accessory position-measurement sensor can comprise and accelerometer or even a gyrometer. According to a first embodiment, the position-measurement sensor can thus cooperate according to a mechanical connection that is embedded, i.e. advantageously fixed to, said accessory device, more particularly on the body of said accessory. According to the preferred example of application described in connection with FIG. 6, such an accessory position-measurement sensor 27 can advantageously be placed on and/or in the body of said stick 26.

If the seating device comprises or cooperates with a support accessory in the form of a stick 26, said accessory comprising an accessory position-measurement sensor 27, the step for decoding a position message M of a method 100 according to the invention, carried out by the processing unit of an electronic object 50 can also consist in extracting from said message the values of the accessory position data. According to this particular arrangement, said position message M can thus comprise several information fields relating to the support accessory 26, such as an identifier of said support accessory, accessory position data of which the values identify the position measurement in real time of said support accessory, i.e. the position of said accessory in relation to a predefined horizontal surface on which the device and the accessory are used such as, for example, the ground, in a terrestrial or inertial frame of reference, the accelerations and/or inclinations of said support accessory according to the accessory position-measurement sensor(s) used. Hereinafter and by way of simplification, we will call such data "accessory position data". Step 110 consists ultimately in obtaining the values of the accessory position data extracted, concomitantly with those of the position data of the device per se.

The electronic object 50 comprising the output means 30, such as, by way of example, a man/machine interface such as a screen or any other equivalent means, to a user of said object and/or device, said output means cooperating with the processing unit of said electronic object 50, a method to assist with using a seating device according to the invention comprises a subsequent step to trigger the display, by the output means 30, of a third indicator (not shown in FIG. 4) expressing said accessory position data. Like the first and second indicators, the display of such a third indicator can advantageously be two- or three-dimensional and consist chiefly in displaying a virtual object the parameters of which can be defined or predetermined. Thus, prior to the step of displaying such a third indicator, a method 100 according to the invention may possibly comprise a step of configuration of the parameters of the graphical representation of such a third indicator, specifically but without limiting the form, texture or even the color palette used.

Whatever the configuration of a method 100 to assist with using a seating device according to the invention, said method 100 being according to the invention, a preferred mode of adaptation of a communication electronic object, such as that described previously, involves recording or downloading into the memory of programs, a computer program product P comprising a plurality of program instructions that, when executed or interpreted by the processing unit of said electronic object cause the implementation of said method 100 to assist with using said seating device according to the invention.

As stated above, the invention also concerns a system to assist with using a pendula seating device. Two preferred but non-limiting embodiments are notably described in connection with FIGS. 3 and 6, said seating device being advantageously in the form of a dynamic pendula stool.

According to FIG. 3, a system 200 to assist with using a pendula seating device according to the invention can comprise said seating device, a remote electronic object 50 comprising communication means ensuring a communication with said seating device, possibly wired or wireless, in the latter case, according to WiFi or Bluetooth communication protocols. Said electronic object is thus according to the invention, i.e. it also comprises in its memory of programs a computer program product P, allowing a method to assist with using a seating device according to the invention to be carried out.

Alternatively, or in addition, according to the second embodiment described in connection with FIG. 6, such a system 200 can also comprise a support accessory in the form of a stick 26 cooperating with said seating device and for which the electronic object 50 comprises in the memory of programs the instructions of a computer program product according to the invention.

The invention has been described during its use and/or application in connection with a pendula stool, dedicated in particular to the implementation of muscle reeducation and/or reinforcement protocols. It can also be implemented for any other dedicated devices, by virtue of their structural characteristics, to establish muscle reeducation and/or reinforcement protocols.

Other modifications can be envisaged without departing from the scope of the present invention defined by the accompanying claims.

The invention claimed is:

1. A method to assist with using a pendula seating device, said device comprising a spherical foot, a seating portion, a body being secured at a first end to said foot and at a second end to the seating portion, a position-measurement sensor being secured to said device, said method being carried out by a processing unit of a remote electronic object, the remote electronic object comprising output means and communication means with said seating device, said method comprising:

a step for decoding a position message of the pendula seating device, said position message being received by the communication means of the remote electronic object and conveying position data, and for extracting therefrom content of said position data, a step for triggering display, by the output means, of a first indicator expressing said extracted position data, said method further comprising a step for generating determined reference position data expressing a target to be reached and a subsequent step for triggering the display, by the output means, of a second indicator expressing said reference position data.

2. The method according to claim 1, wherein the first and/or second indicators comprise first and/or second avatars.

3. The method according to claim 1, carried out iteratively, for which the step for generating the reference position data generates position data values different to those generated during the previous iteration.

4. The method according to claim 3, wherein the value of the reference position data is determined according to a function or a scenario taking into account values of previous position data.

5. The method according to claim 3, wherein the value of the reference position data is determined on the basis of an ordered and predetermined list of reference position values.

6. The method according to claim 3, also comprising a step to count occurrences, during which the values of the extracted position data of the device and the reference position data are substantially identical.

7. The method according to claim 6, also comprising a step to trigger display, by the output means of the remote electronic object, of a current value of the occurrence counter.

8. The method according to claim 3, also comprising a step, prior to the display of the first or second indicator, in order to select, among a plurality of determined graphic representations, a first graphic representation, as soon as there is a mismatch of the respective values between the extracted position data and the reference position data, and/or a second graphic representation, as soon as there is a match of the respective values between the extracted position data and the reference position data.

9. The method according to claim 1, said device also comprising a sensor for measuring pressure exerted along an axis passing through the body from the seating portion to the spherical foot of said device, said method also comprising:

a step to decode a pressure data message relating to said pendula seating device, said message being received by the communication means of the remote electronic object and conveying pressure data, and to extract therefrom content of said pressure data, a step to carry out a determined processing in response to a pressure datum higher than a determined threshold.

10. The method according to claim 9, for which the determined processing comprises a step to generate a validation command of a graphic menu outputted by the output means of the electronic object.

11. The method according to claim 1, the device comprising or cooperating with a support accessory in the form of a stick, said accessory comprising a position-measurement sensor delivering accessory position data transmitted in the position message together with the position data of the body of device, for which, the step for decoding a position message also comprises extracting from said message the value of the accessory position data, said method also comprising a step to trigger display, by the output means, of a third indicator expressing said accessory position data.

12. A computer-readable medium storing a computer program comprising a plurality of program instructions which, when they are:

previously recorded in a memory of the remote electronic object which comprises the processing unit, the communication means with said seating device, and the output means, said memory of programs, said communication means and said output means cooperating with said processing unit; and executed or interpreted by said processing unit, cause the implementation of the method to assist with using said seating device according to claim 1.

13. A computer-readable medium storing a computer program comprising a plurality of program instructions which, when they are:

previously recorded in a memory of programs of the remote electronic object which comprises the processing unit, the communication means with said seating device, and the output means, said seating device comprising or cooperating with a support accessory in the form of a stick, said memory of programs, said communication means and said output means cooperating with said processing unit; and executed or interpreted by said processing unit, cause the implementation of the method to assist with using said seating device according to claim 1.

14. An electronic object comprising a processing unit, a memory of programs, communication means ensuring a proximity communication with a remote seating device and output means, said memory of programs, said communication means and said output means cooperating with said processing unit, wherein the memory of programs contains the instructions of the computer program according to claim 12.

15. A system to assist with using a pendula seating device comprising said seating device, a remote electronic object in communication with said seating device, said remote electronic object being the electronic object of claim 14.

16. A system to assist with using a pendula seating device comprising said seating device, a remote electronic object in communication with said seating device, and a support accessory in the form of a stick cooperating with said seating device, wherein the electronic object comprises a memory of programs in which is stored the instructions of a computer program according to claim 13.

* * * * *